US007418742B2

(12) United States Patent
Yoo

(10) Patent No.: US 7,418,742 B2
(45) Date of Patent: Sep. 2, 2008

(54) PANTS

(76) Inventor: Dae-kyu Yoo, Ssangyong Apt 205-1402, Gonjiam-li 457, Silchon-eup, Gwangju-si, Gyeonggi-do 464-756 (KR)

( * ) Notice: Subject to any disclaimer, the term of this patent is extended or adjusted under 35 U.S.C. 154(b) by 0 days.

(21) Appl. No.: 11/720,169

(22) PCT Filed: Dec. 21, 2005

(86) PCT No.: PCT/KR2005/004417

§ 371 (c)(1),
(2), (4) Date: May 24, 2007

(87) PCT Pub. No.: WO2006/075847

PCT Pub. Date: Jul. 20, 2006

(65) Prior Publication Data

US 2007/0256208 A1 Nov. 8, 2007

(30) Foreign Application Priority Data

Jan. 13, 2005 (KR) ..... 10-2005-0003226

(51) Int. Cl.
*A41D 1/06* (2006.01)
*A41D 13/02* (2006.01)

(52) U.S. Cl. ..... 2/236; 2/227; 2/228; 2/237; 2/220; 2/221

(58) Field of Classification Search ..... 2/227, 2/228, 238, 236, 237, 220, 221
See application file for complete search history.

(56) References Cited

U.S. PATENT DOCUMENTS

| | | | | | |
|---|---|---|---|---|---|
| 749,605 | A | * | 1/1904 | Bieberstein | 2/235 |
| 1,270,190 | A | * | 6/1918 | Morris | 2/237 |
| 3,246,342 | A | * | 4/1966 | Pagano | 2/227 |
| 3,800,330 | A | * | 4/1974 | Bowcut | 2/227 |
| 4,596,055 | A | * | 6/1986 | Aach et al. | 2/237 |
| 4,893,358 | A | * | 1/1990 | Bice, Jr. | 2/221 |
| 5,008,962 | A | * | 4/1991 | Smith et al. | 2/234 |
| 5,033,125 | A | * | 7/1991 | de la Villefromoy et al. | 2/237 |

* cited by examiner

*Primary Examiner*—Gloria Hale
(74) *Attorney, Agent, or Firm*—Tuchman & Park LLC

(57) ABSTRACT

The present invention relates to pants capable of lifting sagging buttocks when a user wears them, thereby giving a sense of comfort as well as a good appearance to the user. The pants include elastic first wings, wherein each one side of the first wings is seamed with both outer edges of the upper portion of a rear fabric panel in a longitudinal direction and the other side of each of the first wings is seamed with a front fabric panel along zipper seam lines, respectively, and second wings wherein each one side of the second wings is seamed, independent from the first wings, to the portions seamed with the first wings in a longitudinal direction and the other side of each of the second wings is seamed with each end of band stitched to both upper end portions of the front fabric panel.

7 Claims, 3 Drawing Sheets

PANTS

REFERENCE TO RELATED APPLICATIONS

This is a continuation of pending International Patent Application PCT/KR2005/004417 filed on Dec. 21, 2005, which designates the United States and claims priority of Korean Patent Application No. 10-2005-0003226 filed on Jan. 13, 2005.

FIELD OF THE INVENTION

The present invention relates to pants, and more particularly to pants capable of lifting the buttocks when a user wears the pants.

BACKGROUND OF THE INVENTION

Pants are an item of clothing that cover the lower limbs of a body movable in a variety of poses and having a large amount of mobility, so that technologies on improving their structure, together with the structure of shirt sleeves, are paid close attention.

Particularly, nowadays, pants having a variety of functions and structures are commercially produced. Further, pants which are stylish and give a sense of comfort to a user when they are worn are being introduced to a market in a variety of structures.

SUMMARY OF THE INVENTION

Generally when people wear pants, their behind does not look good due to sagginess of the buttocks. Accordingly, people who want to look stylish deal with the problem in a variety of ways.

The present invention has been made keeping in mind the above problems occurring in the prior art and to solve these problems, and an object of the present invention is to provide pants that can lift sagging buttocks when a user wears them, thereby giving the user a sense of comfort as well as an improved appearance.

In order to achieve the above objects, according to one aspect of the present invention, pants are made by sewing a front fabric panel and a rear fabric panel, wherein each one side of both first wings made from an elastic fabric are respectively seamed with both outer edges of an upper portion of the rear fabric panel in a longitudinal direction, and further, each one side of both second wings are seamed, independent from the first wings, to the portions of the rear fabric panel with which the first wings were seamed, and wherein the other side of each of the first wings is seamed with a front fabric panel along zipper seam lines of the front fabric panel, and the other side of each of the second wings is seamed together with bands stitched to both the uppermost ends of the front fabric panel, respectively.

Preferably, a length of the one side of the first wings is longer than that of the other side of the first wings, and further a length of the one side of the second wings is longer than that of the other side of the second wings.

As is apparent from the above descriptions, the pants according to the present invention have the advantage of naturally pulling and lifting sagging buttocks, so that the buttocks look rounder, by seaming two separate wings, which are seamed with both upper sides of a rear fabric panel, respectively, with a front fabric panel along zipper seam lines and with both the uppermost portions of the front fabric panel, respectively.

The pants according to the present invention have the further advantage of providing an appealing style and a sense of comfort to a user, thereby giving confidence to a user.

DETAILED DESCRIPTION OF THE INVENTION

Hereafter, embodiments of the present invention will be described with reference to the accompanying drawings.

Figure 1:
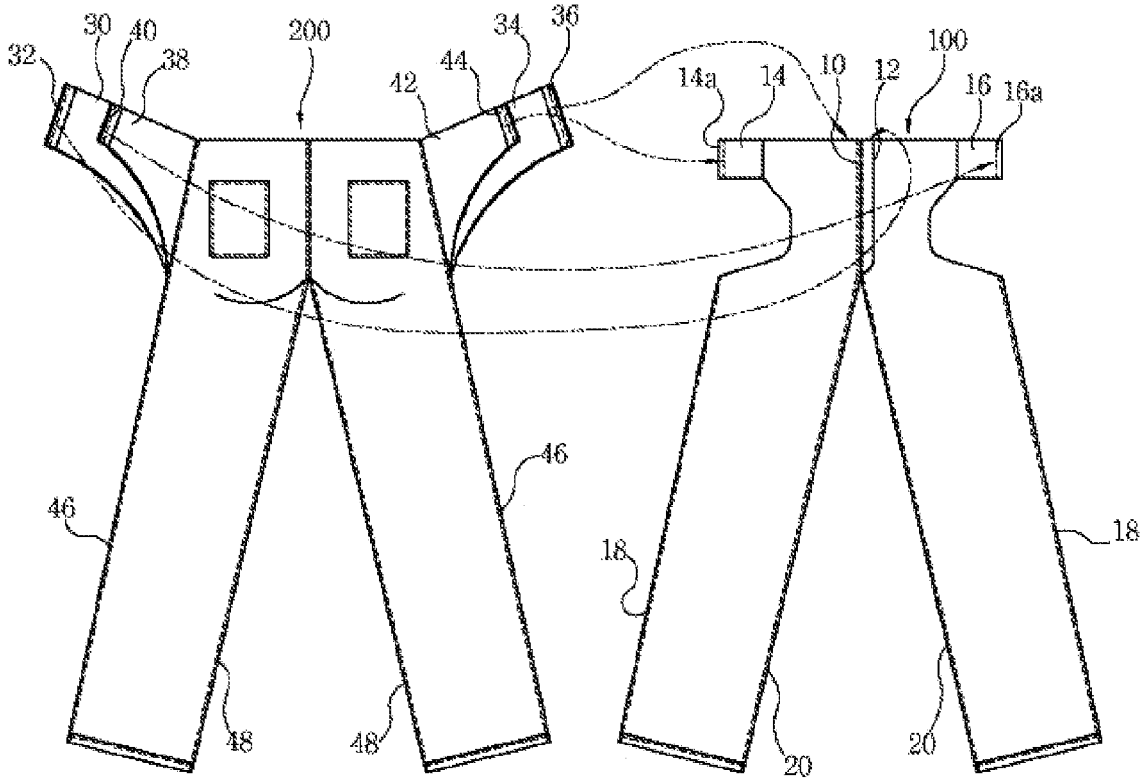
FIG. 1 is an exploded plan view illustrating a front fabric panel and a rear fabric panel of pants according to one embodiment of the present invention.
Figure 2:
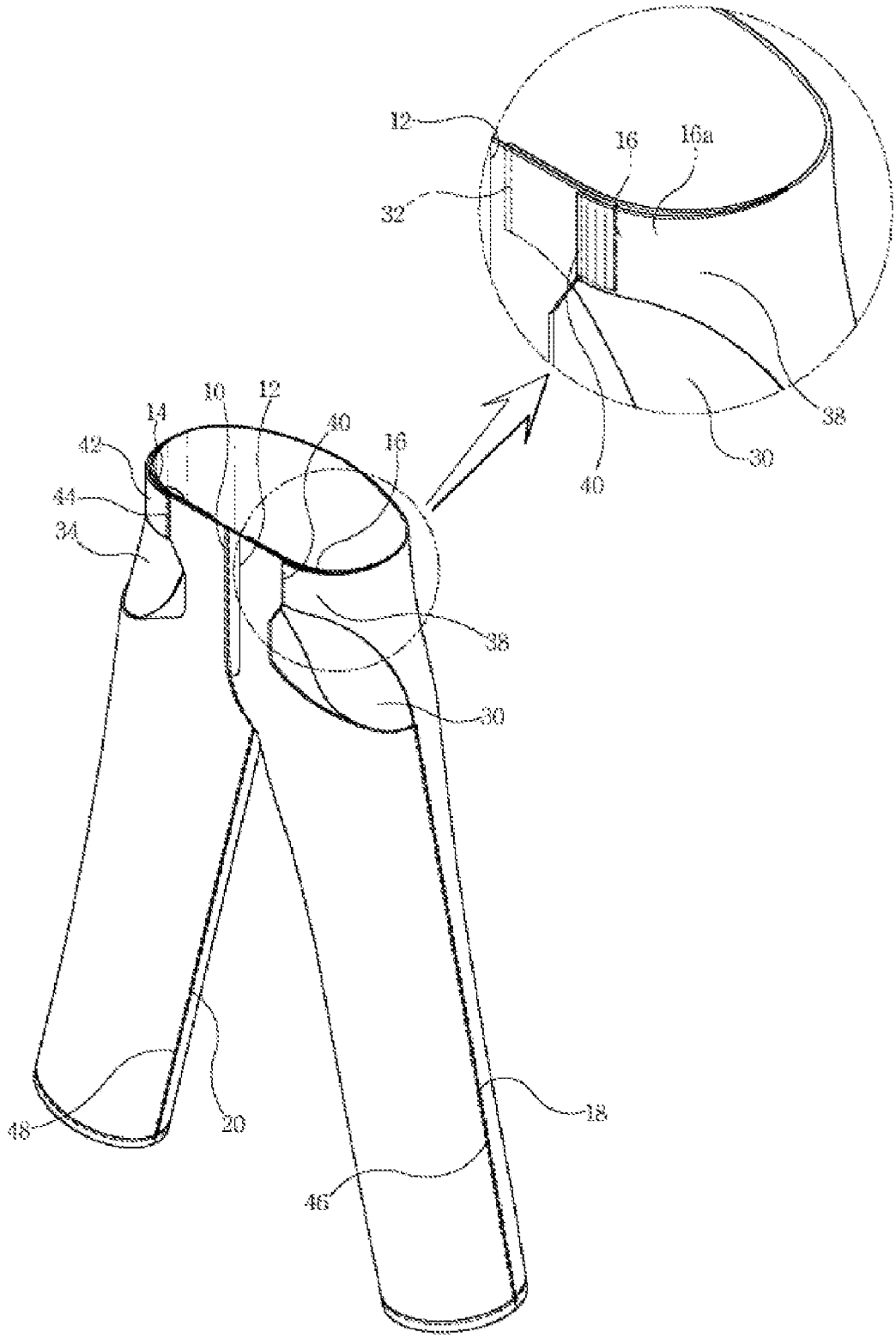
FIG. 2 is a perspective view illustrating the pants made by seaming the front and rear fabric panels, according to the embodiment of the present invention.
Figure 3:
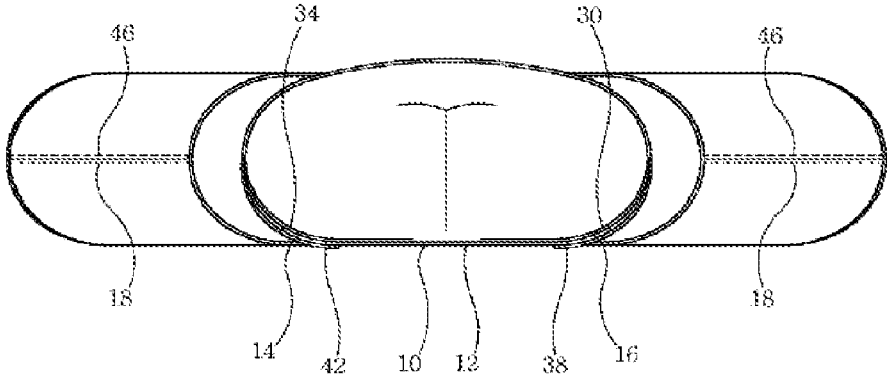
FIG. 3 is a plan view illustrating the pants shown in FIG. 2.

FIG. 1 illustrates elements of pants according to one embodiment of the present invention, FIG. 2 perspectively illustrates the completed pants formed by seaming the front fabric panel with the rear fabric panel shown in FIG. 1, and FIG. 3 illustrates a plan view of the pants shown in FIG. 2.

The pants according to the embodiment of the present invention are made by sewing the front fabric panel 100 and the rear fabric panel 200, which are cut in the certain form, together. First wings 30 and 34 are seamed with the rear fabric panels 200 such that each one side of the first wings 30 and 34 is seamed with both outer edges of an upper portion (corresponding to buttocks) of the rear fabric panel 200 in the longitudinal direction, respectively. Further, each one side of both second wings 38 and 42 is seamed to the portions of the rear fabric panel 200 that is seamed with the first wings 30 and 34 in a longitudinal direction, and independent from the first wings 30 and 34.

The other side of each of the first wings 30 and 34 is seamed with a corresponding zipper seam lines 10 or 12 of the front fabric panel 100, and the other side of each of the second wings 38 and 42 is seamed with both the corresponding uppermost end portions of the front fabric panel 100.

In more detail, the first wings 30 and 34 and the second wings 38 and 42 are tapered into a shape so that a length of each one side of the first wings 30 and 34 is longer than that of the other side of each of the first wings 30 and 34, and a length of each one side of the second wings 38 and 42 is longer than that of the other side of each of the second wings 38 and 42.

The first wings 30 and 34 are made of an elastic material.

Each one side of the first wings 30 and 34 extends from the uppermost end of the rear fabric panel 200 to a portion below where a buttock is placed. The length of the one side of the second wings 38 and 42 is the same as or slightly shorter than that of each one side of the first wings 30 and 34. The second wings 38 and 42, that are seamed with the rear fabric panel 200, are seamed at the rear side of the first wings 30 and 34, respectively.

The second wings 38 and 42 are made of a fabric, and the other sides of the second wings 38 and 42 are respectively seamed with elastic bands 14 and 16 stitched to both uppermost end portions of the front fabric panel 100.

The above described pants according to the present invention are produced according to a method which will be described hereinafter. That is, a fabric for pants is cut into the front fabric panel 100 and the rear fabric panel 200, and the respective front and rear fabric panels 100 and 200 are seamed with each other. That is, inner seam lines 20 of the front fabric panel 100 are aligned with inner seam lines 48 of the rear fabric panel 200, and then the front and rear fabric panels 100 and 200 are seamed together along the inner seam lines 20 and 48. Further, outer seam lines 18 of the front fabric panel 100 and outer seam lines 46 of the rear fabric panel 200 are aligned and then seamed together.

Next, the first wings 30 and 34 seamed with the rear fabric panel 200 are seamed with the front fabric panel 100 along the zipper seam lines 10 and 12. That is, the other side 32 of the first wing 30 is seamed vertically along the zipper seam line 12 and the other side 36 of the first wing 34 is seamed vertically along the zipper line 10.

Next, the second wings 38 and 42 seamed with the rear fabric panel 200 are respectively seamed with the bands 14 and 16 of the front fabric panel 100. That is, the other side 40 of the second wing 38 is seamed with an outer edge 16*a* of the band 16, and the other side 44 of the second wing 42 is seamed with an outer edge 14*a* of the band 14.

Through the above described method, the pants shown in FIG. 2 will be finally produced.

Figure 4:
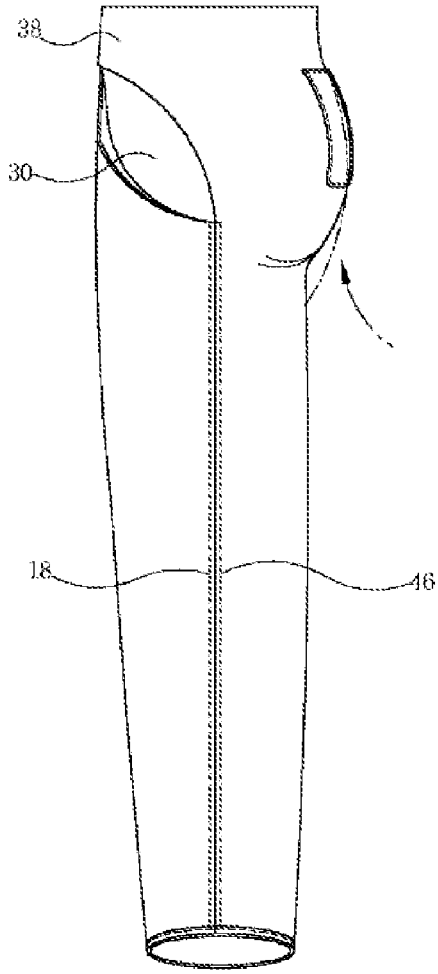
FIG. 4 is a perspective view illustrating the status wherein the pants according to the present invention are used.

In the completed pants, since the other sides of the first elastic wings 30 and 34 seamed with the rear fabric panel 200 are respectively seamed with the zipper seam lines 10 and 12 of the front fabric panel 100, when a user wears the pants, the buttocks region of the pants is naturally pulled up forward, so that the saggy buttocks of a user can be lifted a certain degree as shown in FIG. 4. Accordingly, the user's buttocks will look fuller. Further, since the other sides of the first wings 30 and 34 are respectively seamed with the zipper seam lines 10 and 12 of the front fabric panel 100, the corresponding portion of the rear fabric panel 200 seamed with each one side of the first wings 30 and 34 may happen to be wrinkled because it is pulled toward the front fabric panel 100. In this instance, the second wings 38 and 42 serve to prevent wrinkling. That is, since the other sides of the second wings 38 and 42 seamed with the rear fabric panel are seamed with the bands 14 and 16 of the front fabric panel 100, the second wings 38 and 42 pull both uppermost ends of the front fabric panel 100, thereby removing the wrinkles.

According to the above described embodiment of the present invention, the front and rear fabric panels 100 and 200 are seamed along the seam lines 18, 20, 46 and 48, initially, and then the first and second wings 30, 34, 38 and 42 seamed with the rear fabric panel 200 are seamed with the front fabric panel 100 afterwards. However, the pants of the present invention are not limited thereto. That is, the pants can be produced by seaming the first and second wings 30, 34, 38 and 42, that are seamed with the rear fabric panel 200, with the front fabric panel 100, respectively, initially, and then seaming the front fabric panel 100 with the rear fabric panel 200 afterwards.

Although preferred embodiments of the present invention have been described for illustrative purposes, those skilled in the art will appreciate that various modifications, additions, and substitutions are possible, without departing from the scope and spirit of the invention as disclosed in the accompanying claim.

What is claimed is:

1. Pants comprising:

a front fabric panel formed generally in a pants shape with a body portion and two leg portions extending downwardly from the body portion;

a rear fabric panel formed generally in a pants shape with a body portion and two leg portions extending downwardly from the body portion, the rear fabric panel seamed with the front fabric panel;

a pair of first wings made of an elastic material, each of the first wings having a first lateral side seamed with an upper lateral portion of the rear fabric panel, and a second lateral side seamed with the front fabric panel along a zipper seam line, the zipper seam line located at a central area of the body portion of the front fabric panel;

a pair of second wings, each of the second wings having a first lateral side seamed, independently from the first wings, to the portion of the rear fabric panel with which the first lateral side of the first wings are seamed, and a second lateral side seamed with a band member attached at an uppermost lateral side of the front fabric panel.

2. The pants as claimed in claim 1, wherein a length of the first lateral side of the first wings is longer than that of the second lateral side of the first wings.

3. The pants as claimed in claim 1, wherein a length of the first lateral side of the second wings is longer than that of the second lateral side of the second wings.

4. The pants as claimed in claim 1, wherein a length of the first lateral side of the second wings is the same as or slightly shorter than that of the first lateral side of the first wings.

5. The pants as claimed in claim 1, wherein a hip portion of the pants has a tendency of tightening upwardly when a wearer wears the pants, due to the elastic first wings.

6. The pants as claimed in claim 1, wherein each band member attached at the uppermost lateral side of the front fabric panel is formed of an elastic material.

7. The pants as claimed in claim 6, wherein a hip portion of the pants has a tendency of tightening upwardly while reducing wrinkling, when a wearer wears the pants, due to the elastic first wings and the elastic band members.

* * * * *